US006530508B1

(12) United States Patent
Devine

(10) Patent No.: US 6,530,508 B1
(45) Date of Patent: Mar. 11, 2003

(54) UTILITY WRISTBAND

(76) Inventor: Rita M. Devine, 2930 Prospect St., Sarasota, FL (US) 34239

( * ) Notice: Subject to any disclaimer, the term of this patent is extended or adjusted under 35 U.S.C. 154(b) by 0 days.

(21) Appl. No.: 09/954,493

(22) Filed: Sep. 17, 2001

(51) Int. Cl.[7] ..... A45F 5/00
(52) U.S. Cl. ..... 224/183; 224/221; 224/267
(58) Field of Search ..... 224/183, 219, 224/221, 222, 223, 267; 600/9, 15

(56) References Cited

U.S. PATENT DOCUMENTS

| | | | | |
|---|---|---|---|---|
| 3,943,912 A | * | 3/1976 | Nakayama | 600/15 |
| 4,325,504 A | | 4/1982 | Amani | |
| 4,826,059 A | | 5/1989 | Bosch et al. | |
| D317,730 S | | 6/1991 | Mo | |
| 5,333,767 A | | 8/1994 | Anderson | |
| 5,450,858 A | | 9/1995 | Zablotsky et al. | |
| 5,593,073 A | | 1/1997 | Finnegan | |
| 5,707,333 A | * | 1/1998 | Bakst | 600/9 |
| 5,904,280 A | | 5/1999 | Chan | |
| 6,129,659 A | * | 10/2000 | Wilk | 600/9 |

* cited by examiner

*Primary Examiner*—Nathan J. Newhouse
(74) *Attorney, Agent, or Firm*—Charles J. Prescott

(57) ABSTRACT

A magnetic utility wristband for holding magnetically attractable metallic work items thereagainst for convenient access. The wristband includes an elongated flexible band sized in length to wrap around the wrist of a worker. End portions of the wristband include two-part releasably attachable hook and loop surfaces on corresponding overlapping inner and outer end portion surfaces whereby the band is releasably adjustably connectable only around the worker's wrist. A plurality of elongated magnetic bars are held along a central portion of the wristband in spaced substantially parallel relation one to another transversely to the length of the wristband and between the outer and inner flexible panels by a plurality of transverse spaced stitch lines connecting said outer and inner panels to form individual elongated pockets each of which hold and position one magnetic bar. By preferred alternating surface polarity of adjacent magnetic bars, the devices may be shortenable for small wrist sizes and fully collapsible in accordion fashion for storage.

1 Claim, 5 Drawing Sheets

UTILITY WRISTBAND

BACKGROUND OF THE INVENTION

1. Scope of Invention

This invention relates generally to a wristband for worker's and handymen, and more particularly to an improved wristband for holding magnetically attractable objects such as screws, nails, nuts, bolts, washers and the like for convenience.

2. Prior Art

Workmen and handymen typically need more than two hands at once to effectively control and have available the various items and tools required for a project. The ready availability of small metallic work objects such as nails, screws, nuts, bolts, tacks, washers and any other type of magnetically attractable objects is many times inconvenient. They become scattered or are in an unavailable or inaccessibly reachable position just when other tool implements and work pieces are in alignment and requiring their availability.

Prior art does disclose other devices which are intended to provide a magnetic surface attachable to torso or wrist which will retain magnetically attractable objects in a convenient location ready for use.

One such invention is disclosed by Finnegan in U.S. Pat. No. 5,593,073. This invention is directed to a workman's wristband which is releasably connectable around the wrist of the workman and having a central padded area including a small metallic surface for holding such metallic objects for convenience.

Another magnetic tool holder invented by Bosch and disclosed in U.S. Pat. No. 4,826,059 is generally directed to an apron having a plurality of sets of magnetic strips which are oriented toward the upper margin of the apron for attaching tools such as pliers and wrenches, along with other work objects such as nuts, bolts, nails and the like.

U.S. Pat. No. 5,333,767 teaches a wrist mounted magnetic holder invented by Anderson which includes ceramic magnetic polarized magnets mounted in a holder for conveniently retaining small articles such as nails, screws, bolts, drill bits and the like. This device includes two distinct regions and a flux concentrator for increasing the magnetic flux density at the holding surface.

Another combined magnetic holder with armband is disclosed in U.S. Design Pat. No. 317,730 invented by Mo.

Several other prior art devices are known to applicant including portions which are magnetized by magnet segments included therein as follows. These patents are only remotely similar to the structure and function of the present invention.

U.S. Pat. No. 5,450,858 to Zablotsky et al.

U.S. Pat. No. 6,093,143 to Nagler

U.S. Pat. No. 6,146,324 to Engel

U.S. Pat. No. 5,950,239 to Lopez

U.S. Pat. No. 5,904,280 to Chan

U.S. Pat. No. 3,636,568 to Stuner

U.S. Pat. No. 4,325,504 to Amani

The present invention discloses a utility wristband which is adjustably and releasably connectable around the wrist of the use and includes a plurality of magnetic bars which are oriented in spaced generally parallel side-by-side relationship and held between inner and outer flexible fabric panels for retaining small magnetically attracted metal work objects such as screws, nuts, bolts, nails, washers and the like for convenient access to a worker wearing the device. The preferred embodiment includes magnet bar orientation which will provide a convenient self-closing feature for compactness which also acts to partially shorten the overall length of the device should a worker using the device have a wrist of small dimension.

BRIEF SUMMARY OF THE INVENTION

This invention is directed to a magnetic utility wristband for holding magnetically attractable metallic work items thereagainst for convenient access. The wristband includes an elongated flexible band sized in length to wrap around the wrist of a worker. End portions of the wristband include two-part releasably attachable hook and loop surfaces on corresponding overlapping inner and outer end portion surfaces whereby the band is releasably adjustably connectable only around the worker's wrist. A plurality of elongated magnetic bars are held along a central portion of the wristband in spaced substantially parallel relation one to another transversely to the length of the wristband and between the outer and inner flexible panels by a plurality of transverse spaced stitch lines connecting said outer and inner panels to form individual elongated pockets each of which hold and position one magnetic bar. By preferred alternating surface polarity of adjacent magnetic bars, the devices may be shortenable for small wrist sizes and fully collapsible in accordion fashion for storage.

It is therefore an object of this invention to provide a utility wristband for holding magnetically attractable metal work objects such as screws, nuts, bolts, nails, washers, brads and the like in a convenient location for ready access to a worker wearing the device.

It is another object of this invention to provide a utility wristband for retaining magnetically attractable metallic objects against the outer surface of the wristband and also providing an automatic storing feature which compactly folds the device in accordion fashion into a convenient size for carrying in a pocket, apron or purse.

It is still another object of this invention to provide a utility wristband which will retain magnetically attractable objects on an outer surface of the device and which includes an automatically adjustable length feature by the preferred orientation of plurality of the spaced elongated magnetic bars contained between the inner and outer flexible panels of the device.

In accordance with these and other objects which will become apparent hereinafter, the instant invention will now be described with reference to the accompanying drawings.

DETAILED DESCRIPTION OF THE INVENTION

Figure 1:
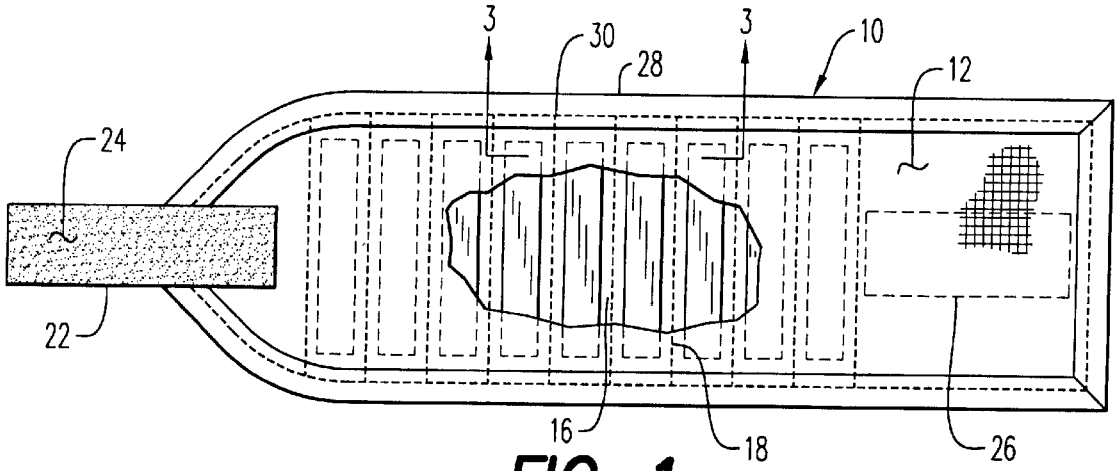
FIG. 1 is a top plan view of the invention.

Referring now to the drawings, the preferred embodiment of the invention is there shown in all views at numeral 10. The utility wristband 10 includes an outer flexible panel 12 and an inner flexible panel 14 which are generally coextensive and which are connected together along common margins by edge stitching 30. A hem piece 28 surrounds and encloses the raw edges of the inner and outer panels 14 and 14 respectively, the hem piece 28 also held by stitching 30 as shown.

Figure 6:
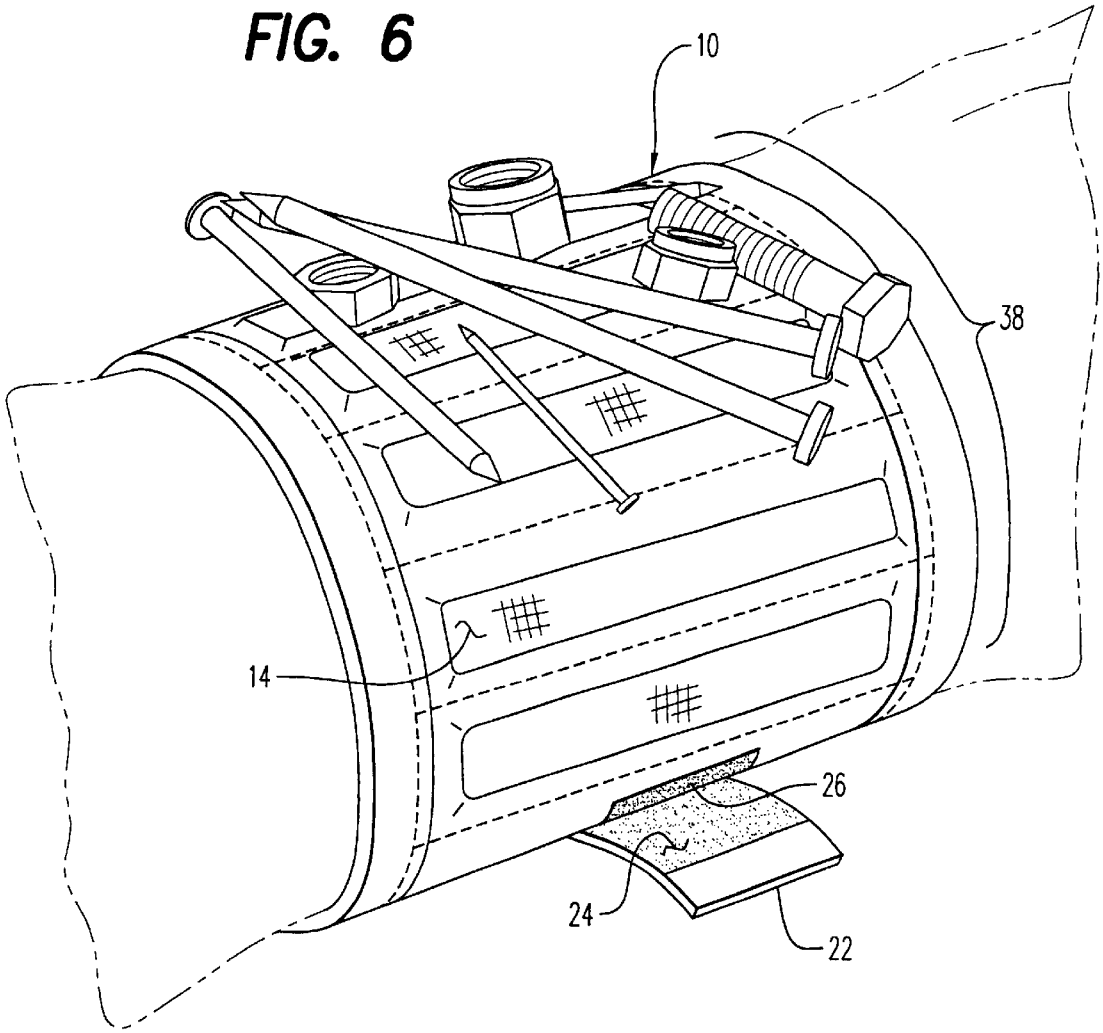
FIG. 6 is a perspective view of the preferred embodiment of the invention installed and in use around the wrist of a user and in use.

One end portion of the wristband 10 includes a tab or flap 22 having one side thereof covered with one portion 24 of a hook and loop releasable attaching arrangement such as VELCRO. The opposite end of the wristband 10 includes the other mating portion 26 of the hook and loop arrangement whereby the device 10 may be releasably attached as best seen in FIG. 6 around the wrist of the user and held fully extended and in place thereby.

Positioned between the inner and outer panels 12 and 14 is a central portion 38 which includes a plurality of elongated magnetic bars 20 formed of strontium magnet material which is held in position in a transverse orientation with respect to the length of the device 10. Each of the magnetic bars 20 are separately held within one of the pockets 16 formed between lines of transverse stitching lines 18 which attach the inner and outer flexible panels 12 and 14 together. The magnetic bars 20 are similar in length to the width of the wristband 10 between the rows of stitching 30. Each of the transverse stitching lines 18 additionally provide fold lines which will be described in more detail herebelow.

Figure 3:
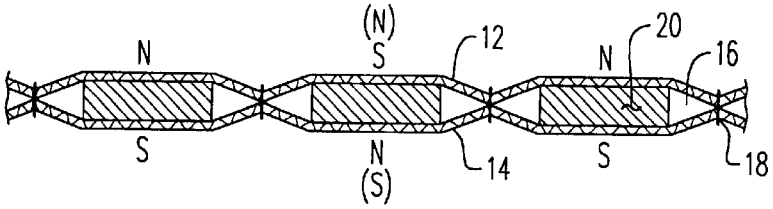
FIG. 3 is a section view in the direction of arrows 3—3 in FIG. 1.

In the preferred embodiment 10, each of the magnetic bars 20 is oriented with opposite surface polarities with respect to the next adjacent magnetic bars so that, as best seen in FIG. 3, each adjacent magnetic bar 20 has the corresponding magnetic surface of opposite polarity. By this arrangement, when tension or stretching force is released from the end portions the plurality of magnets 20 cause the stitch fold lines 18 to fold or double back on themselves into the orientation of the plurality of magnets shown in FIG. 4 at 32.

Figure 4:
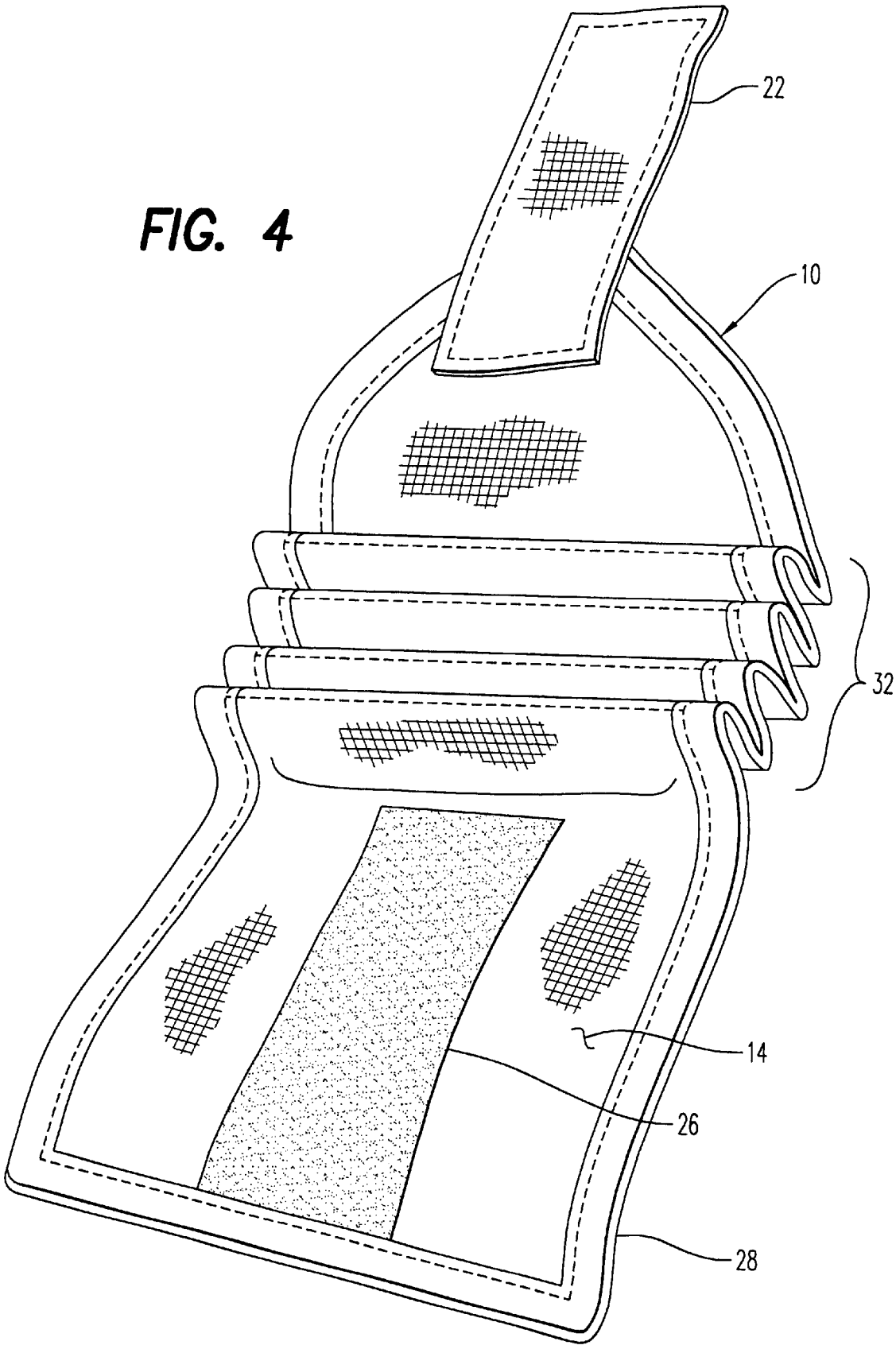
FIG. 4 is a perspective view of the preferred embodiment of the invention in a partially retracted or shortened position for storage or for encircling a small wrist of a worker.
Figure 7:
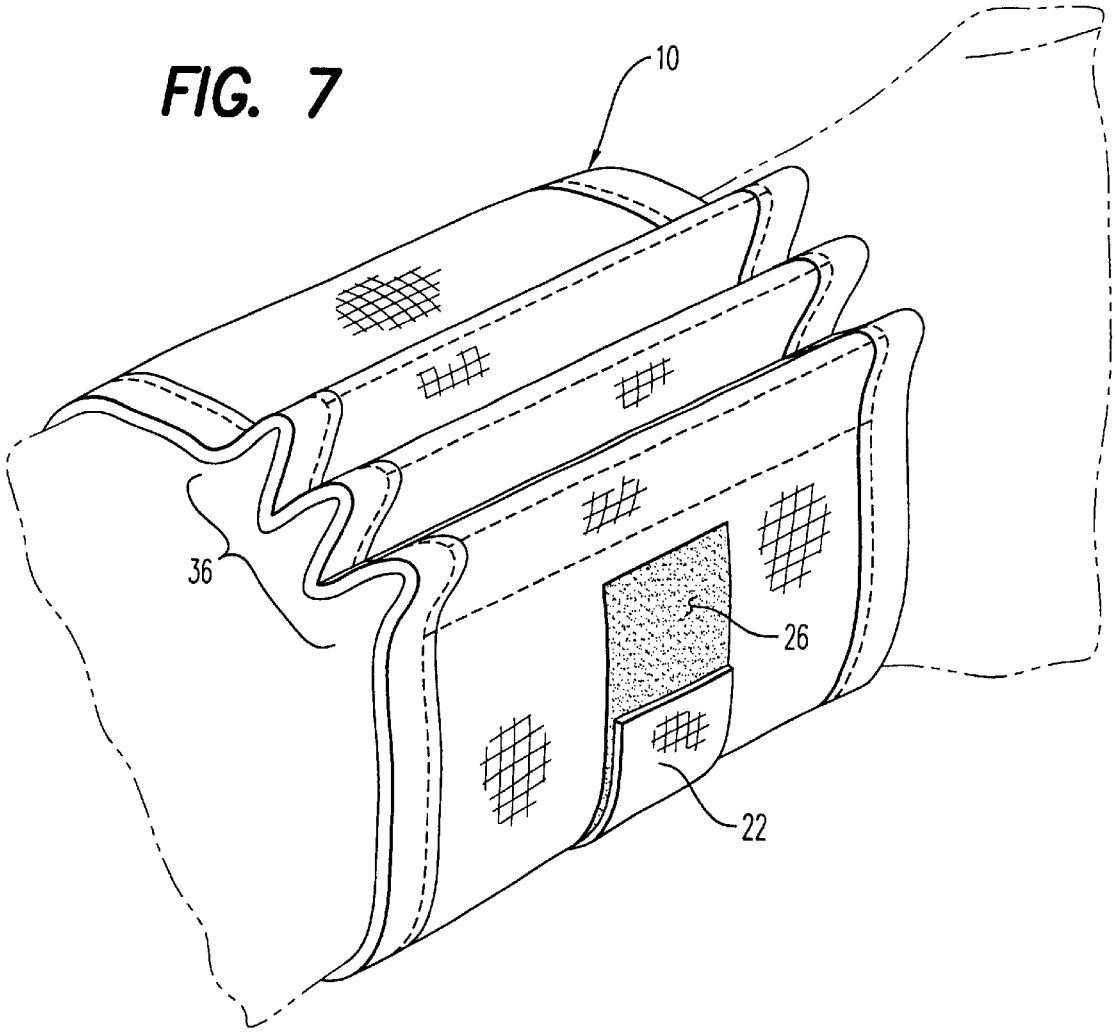
FIG. 7 is a perspective view similar to that of FIG. 6 showing the automatic length-shortening feature of the invention.

In the configuration shown in FIG. 4 with the magnets attached to one another in the array 32, the overall length of the device 10 is substantially shortened. As best seen in FIG. 7, the number of pairs of magnets 20 such as that shown in 36 are variable so as to correspondingly vary the overall effective length of the device 10 for attachment around smaller wrists.

When fully installed as best seen in FIG. 6 onto the wrist of a work person, the entire central portion 38 of the device 10 and the magnetic bars 20 contained therewithin will magnetically attract and hold metallic work objects against the exposed surface of the outer panel 14 by magnetic attraction to metallic work objects such as those shown, namely nails, nuts, bolts, screws, washers and the like. These work objects are thusly made readily accessible to the worker during further activity in preparation for their installation.

Figure 5:
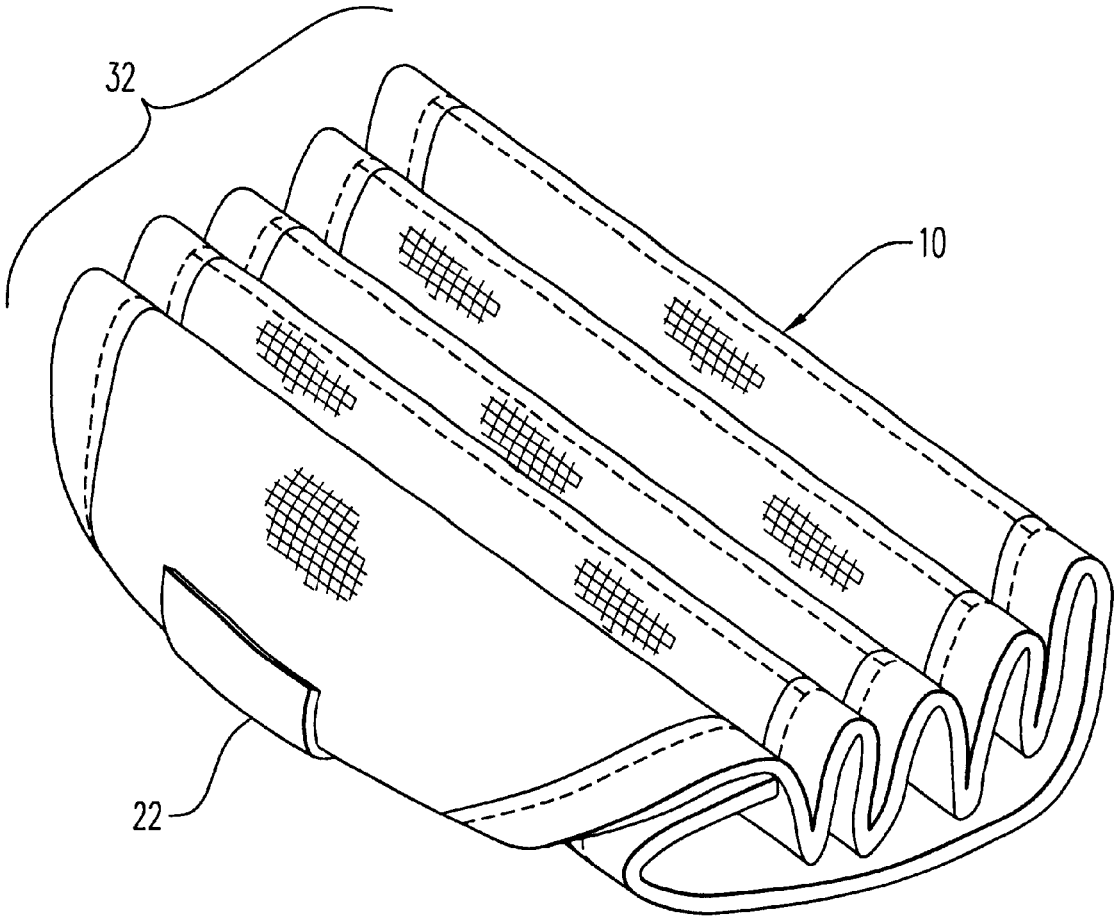
FIG. 5 is a perspective view of the preferred embodiment of the invention in a closed and stored position.

A further benefit of the alternate polarity of the magnetic bars 20 is shown in FIG. 5 wherein the entire array of magnetic bars 20 are allowed to attach against one another in the magnetic bar array 32. Thereafter, the flap or tab 22 is wrapped around and attached to the mating surface 26 to retain the compact stored configuration of the device 10 for easy carrying and stowage.

Figure 2:
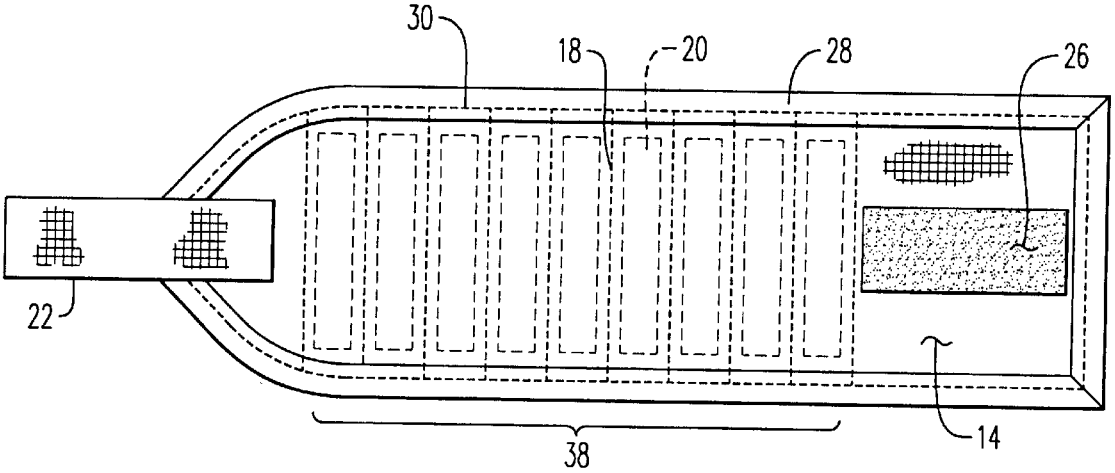
FIG. 2 is a bottom plan view of the preferred embodiment of the invention.

Referring again to FIG. 3, by reorienting the alternate polarity of the magnetic bars 20 so that the same polarity is aligned with each of the inner and outer panels 12 and 14, respectively as shown in parenthesis, the automatic folding or retracting feature previously described in the preferred embodiment is eliminated or made inoperative. When the magnetic bars 20 are so oriented with each of the polarities oriented in the same direction, the device will exhibit no tendency to fold upon itself about the stitch lines 18, but rather will be maintained in the outstretched orientation of the device as seen in FIGS. 1 and 2. Note that the elongated pockets 16 are sufficiently wide to allow the selected magnetic bars 20 to be rotated axially 180° to enable selection of the preferred polarity for the desired functionality in this regard.

The outer flexible panel 12 cannot have a thickness or fabric density which could substantially reduce the attractive magnetic flux of each of the magnetic bars 20. The preferred fabric is a 70 denier imitation microfiber. The inner flexible panel 14 may be somewhat heavier, preferably 420–840 denier nylon, but should not be so thin or stiff so as to excessively stiffen the folding characteristics of the stitch lines 18 as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A utility wristband comprising:

an elongated flexible band sized in length to wrap around the wrist of a worker, said band having end portions, a central portion between said end portions, and an outer flexible panel and an inner flexible panel connected together along common side and end margins;

said end portions including two-part releasably attachable hook and loop surfaces on corresponding overlapping said surfaces whereby said band is releasably adjustably connectable only around the worker's wrist;

a plurality of elongated magnetic bars held in spaced substantially parallel transverse relation one to another extending along said central portion between said outer and inner flexible panels by a plurality of transverse spaced stitch lines connecting said outer and inner panels to form individual elongated pockets for separating and holding each said magnetic bar;

whereby magnetically attractable metallic work items are magnetically adhered against said outer panel for convenient access;

each magnetic bar of said plurality of magnetic bars having a surface polarity thereof oppositely oriented to that of the next adjacent magnetic bar, each said stitch line forming a fold line whereby, to the extent that said wristband is completely or partially relaxed with respect to tension applied in opposite directions to said end portions, at least two adjacent magnetic bars will, by mutual magnetic attraction, attach against one another by folding said stitch line therebetween to reduce the overall length of said wristband.

* * * * *